United States Patent [19]

Goedde et al.

[11] 3,959,083

[45] May 25, 1976

[54] METHOD AND APPARATUS FOR QUENCHING OF HEATED BULK MATERIALS

[75] Inventors: Franz Goedde, Aachen; Heinz Hoeller, Siersdorf, both of Germany

[73] Assignee: Eschweiler Bergwerks-Verein Aktiengesellschaft, Herzogenrath-Kohlscheid, Germany

[22] Filed: Apr. 11, 1974

[21] Appl. No.: 460,073

[30] Foreign Application Priority Data

Apr. 19, 1973 Germany ..... 2320057

[52] U.S. Cl. ..... 201/39; 202/227

[51] Int. Cl.[2] ..... C10B 39/00; C10B 47/00; C10B 49/00

[58] Field of Search ..... 201/39; 202/227–230

[56] References Cited

UNITED STATES PATENTS

| | | | |
|---|---|---|---|
| 469,867 | 3/1892 | Osbourn | 202/227 |
| 469,868 | 3/1892 | Osbourn | 202/227 |
| 761,251 | 5/1904 | Price | 202/227 |
| 3,367,844 | 2/1968 | Cremer | 202/227 |
| 3,809,619 | 5/1974 | Drebes et al. | 201/39 |

FOREIGN PATENTS OR APPLICATIONS

| | | | |
|---|---|---|---|
| 364,236 | 1/1932 | United Kingdom | 202/227 |
| 517,066 | 5/1931 | Germany | |

*Primary Examiner*—Jack Sofer
*Attorney, Agent, or Firm*—Wolfgang G. Fasse; Willard W. Roberts

[57] ABSTRACT

In the present method the bulk material, especially coke, is maintained at a substantially constant level on a substantially horizontal support surface. The quenching liquid is permitted to flow uniformly through the bulk material for about 45 to 90 seconds until the vapor temperature is cooled down to at least 400°C. The quantity of the quenching liquid which is uniformly distributed over the bulk material is selected so that it evaporates substantially completely, except for a small moisture content in the quenched material. The present bulk material quenching apparatus has a fireproof container resting on a supporting box, the top of which is a grid structure which simultaneously forms a permeable bottom for the quenching container which is provided with a tightly closing cover. A pipe conduit is connected to the cover which has a plurality of conduit outlet openings directed into the container. The box on which the container rests has at least one hinged side wall.

11 Claims, 4 Drawing Figures

METHOD AND APPARATUS FOR QUENCHING OF HEATED BULK MATERIALS

BACKGROUND OF THE INVENTION

The present invention relates to a method and apparatus for quenching heated bulk materials, especially coke. The quenching liquid flows from the top of the bulk material downwardly through the bulk material, whereby the material is confined against the atmosphere. The vapor generated from the quenching liquid flows in parallel with the quenching liquid downwardly through the material.

It is desirable to produce a substantially dry coke. With this aim in mind, devices have been suggested heretofore, for performing a quenching method. Such devices comprise a mobile quenching car including a cover which closes off the coke from the atmosphere. These quenching cars have a bottom which is slanted against the horizontal and which is provided with vapor exit openings. Thus, the vapor generated during the quenching is forced to flow through the hot or burning coke in parallel flow with the quenching liquid. Due to the slanted bottom of the quenching car, the coke in the quenching car forms a layer which has a depth varying with the width of the car. Thus, the quenching liquid and the resulting vapor flowing in the same direction through the coke must flow through said differing depths.

All the prior art devices require a slanted bottom in the quenching car in order to provide a flow-off for the excess quenching liquid. Thus, the non-uniform depth of the bulk material over the width of the car could not be avoided. Due to the non-uniform depth of the bulk material, it has not been possible heretofore to achieve a uniform quenching. Thus, it has been suggested to adapt the quantity of the quenching liquid to the depth of the bulk material. In other words, it is known in the art to supply more quenching liquid over the deeper portion of the bulk material and to reduce the quantity of the quenching liquid toward the less deeper portion of the bulk material. However, even with this approach a uniform quenching has not been achieved. The distribution of the quenching liquid over a given surface in response to the depth of the bulk material resting on such surface involves substantial costs. However, even if one disregards such costs, a uniform quenching cannot be accomplished because the vapor tends to flow along the path of the least resistance. As a result, quite different flow conditions may exist from point to point over the surface on which the bulk material rests.

It becomes understandable that prior art quenching devices of the type described above have found hardly any practical acceptance if one takes into account the non-uniform quenching resulting from the tilted bottom surface of the quenching car and if one takes into account the further phenomenon which is also known as the Leidenfrost phenomenon. According to this phenomenon, water is repelled from a hot surface, because a vapor skin is formed around a water droplet. As a result, the droplets tend to run down along the slope of the bulk material without effectively participating in the quenching process. Further, in the second half of the quenching phase the generated vapor tends to flow upwardly in a counter-current relative to the down-flowing quenching water. The counter-current vapor flow tends to impede the penetration of the quenching liquid into the bulk material. As a matter of fact, the super-heated vapor rising out of the bulk material absorbs a portion of the water until the vapor becomes saturated. This water is thus removed from participating in the quenching process. For these reasons it is apparent that prior art quenching devices leave room for improvement.

Another drawback of prior art devices is seen in that it is not possible to produce a quenched bulk material having a uniformly low moisture content. Achieving such a low moisture content is not possible, because the lower portions of the bulk material must take up or absorb the excess quenching liquid which becomes available toward the end of the quenching process. It is not possible to avoid such excess of quenching liquid because the liquid is required for a complete quenching of the upper portions of the bulk material. Furthermore, it has not been possible in connection with the use of prior art quenching devices to achieve a uniform vapor temperature throughout the body of the bulk material, because the quenching had to be continued until the vapor temperature is below 400°C throughout the body of the bulk material in order to avoid partial self-ignitions in the bulk material. As a result, the lower layers or portions of the bulk material used to contain at the end of the quenching process a substantially higher moisture content than the upper layers or portions of the bulk material.

According to another prior art process, it is suggested to avoid the finely distributed spraying of the quenching liquid over the coke and to employ instead compact flows of quenching liquid which are forced into the coke bed under pressure. The purpose of this type of quenching is to assure that the quenching liquid rapidly penetrates the higher portions of the bulk material. Further, just as in the above described prior art method, the liquid flows along the tilted bottom of the quenching car, whereby a partial evaporation takes place continuously and the evaporating vapor is supplied to the bulk material above the bottom of the car for cooling the bulk material. This method has the same disadvantages as the above described method, which results from the slanted arrangement of the bulk material. In addition, a very substantial proportion of the available heat of the coke is removed by the portion of the quenching liquid which does not vaporize. This apparently also contributes to the final moisture content of the resulting coke product.

OBJECTS OF THE INVENTION

In view of the above, it is the aim of the invention to achieve the following objects singly or in combination:

to provide a method for the quenching of a heated bulk material, especially coke which avoids the drawbacks and disadvantages of the prior art;

to assure that the quenching liquid flowing through the bulk material participates completely or substantially completely in the quenching;

to utilize the vapor generated by the quenching for taking up the super-heating heat, whereby the quenching process must not be accompanied by the dust emissions encountered heretofore;

to employ the quenching water efficiently, so that substantially no quenching water quantities remain after the completion of the quenching process;

to avoid the use of slanted bottoms in the quenching car;

to distribute the quenching liquid uniformly over the surface of the bulk material to be quenched;

to determine the liquid quantity necessary for the quenching within such narrow tolerances that no excess quenching liquid will become available, and hence the removal of excess quenching liquid will be obviated;

to avoid the costly means which heretofore have been necessary for the cooling, cleaning, and recovering as well as for the conveying of the quenching liquid; and to assure a cleaner quenching of hot bulk materials, especially coke by using the bulk material itself as a filter for the coke dust which is produced during the quenching so that a substantial proportion of such coke dust is entrapped in the body of the coke being quenched.

SUMMARY OF THE INVENTION

According to the invention there is provided a method for quenching heated bulk materials, especially coke in which the depth of the body of bulk material is maintained substantially uniformly over the entire substantially horizontal supporting surface, and wherein the quenching liquid as well as the vapor formed from the quenching liquid flow uniformly through the body of the bulk material for about 40 to 90 seconds until the vapor temperature is cooled down to at least 400°C. The quantity of cooling liquid is uniformly distributed over the surface of the bulk material and such quantity is determined in such a manner that the quenching liquid evaporates substantially completely except for a proportion which is absorbed by the quenched material or coke. Preferably, such proportion does not exceed 2% of the entire quenching liquid quantity.

It will be appreciated that the method according to the invention completely avoids the slanted positioning of the bulk material for the purpose of quenching. Further, the determination of the quantity of quenching liquid in narrow tolerances assures that excess quenching liquid will not become available which has the advantage that a removal of such excess quenching liquid has been obviated. The evaporation of the quenching liquid substantially without any residue completely departs from the prior art method. Such substantially complete evaporation of the quenching liquid is based on the recognition that, for example, in connection with the quenching of coke, the vapor is capable of taking up super-heating heat at slight gauge pressures and at temperatures within the range of about 700°C down to about 250°C.

Further important advantages of the invention are seen in that it contributes to the reduction of pollution of the environment in that no hot quenching liquid becomes available because the entire water quantity employed for the quenching is converted into highly super-heated water vapor, whereby devices for the cooling, cleaning and recovery as well as for the conveying of the quenching liquid are avoided.

The environment pollution is also reduced according to the invention by the fact that the coke dust which is generated by the quenching is prevented from escaping into the atmosphere. The closing of the quenching car during the quenching as taught herein prevents the escape because it assures that during the quenching the coke dust is retained to a substantial extent in the body of the coke being quenched which acts as a filter. This is considered to be a substantial contribution to ecological requirements.

According to the invention there is further provided an apparatus for performing the present method. Such apparatus comprises a fireproof container with a permeable bottom and a tightly closing cover connected to a pipe conduit. The cover is further provided with a plurality of exit openings facing into the container preferably in a uniform distribution over the surface of the container. The container rests on a box having an upper portion in the form of a grid or grating which simultaneously constitutes the permeable bottom of the quenching container. At least one side wall of the box is hinged to the box by hinge means having a horizontal axis extending preferably along the upper edge of the box so that said hinged side wall may be tilted outwardly.

It is advantageous to dimension the container in such a manner that the quantity of bulk material to be quenched has a depth as large as possible over a supporting surface which is as small as possible. This feature has the advantage that a so called single point positioning may be employed for a quenching car of the type employed in connection with the coke quenching. The so called single point positioning makes it especially possible that the transfer system between a coking oven chamber and the quenching car may be of compact construction. This in turn has the advantage that relatively simple means may be employed in order to assure a reliable environmental protection by the complete suppression of dust emission at the time when the coke is pushed out of the coking oven chamber into the quenching car.

BRIEF FIGURE DESCRIPTION

In order that the invention may be clearly understood, it will now be described, by way of example, with reference to the accompanying drawings, wherein.

DETAILED DESCRIPTION OF EXAMPLE EMBODIMENTS

Figure 1:
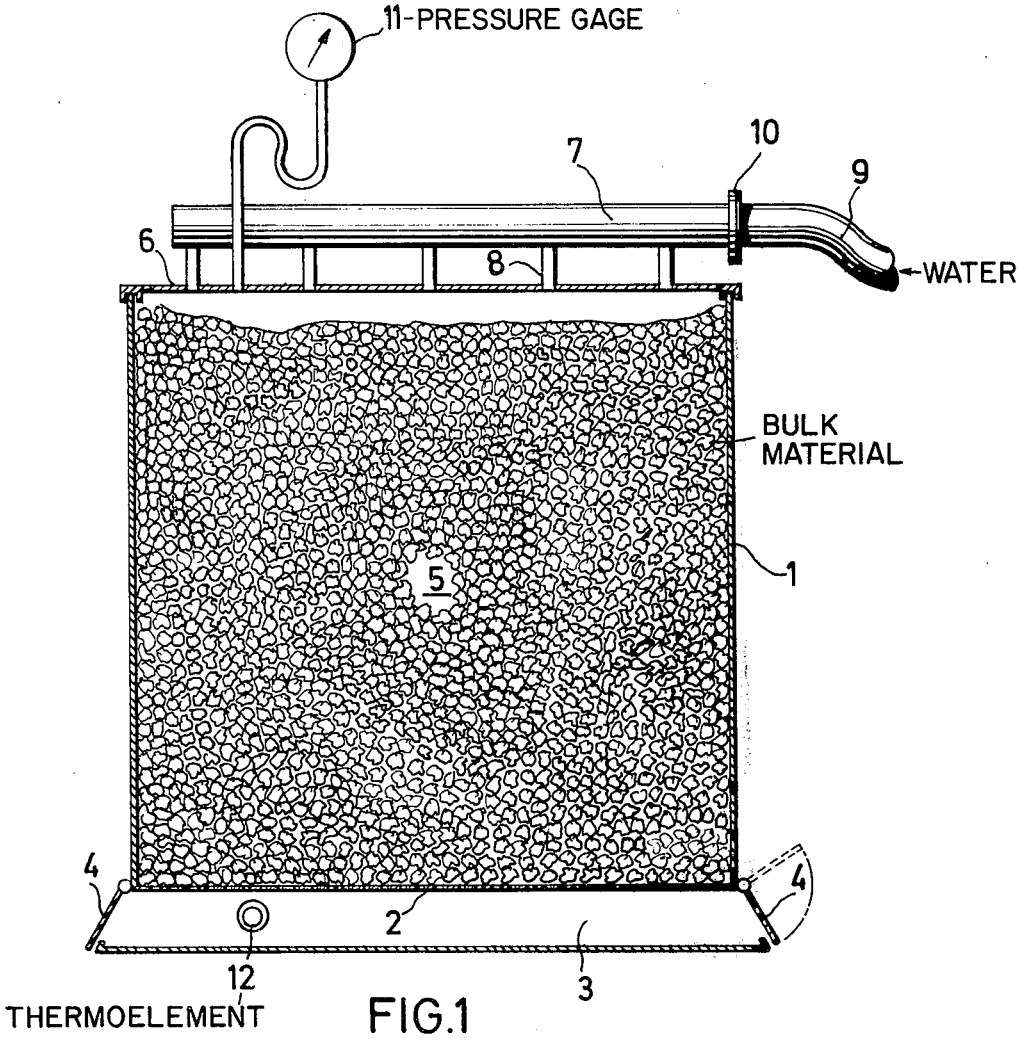
FIG. 1 shows a side view, partially in section, through a test apparatus suitable for performing the present invention.

Referring to FIG. 1, there is shown a substantially cubical container 1 having a side length of about 1 meter and a perforated bottom 2. This apparatus is suitable for performing the present method on a test scale. The container 1 rests on a box 3 which is tightly closed at the bottom and along two of its sides. The remaining two sides of the box 3 preferably comprise tightly closing, but movable side walls 4, which may, for example, be hinged to the upper edges of the box 3. The bulk material 5, for example coke, is located in the container 1 and may have a temperature of about 1,000°C. The container 1 is tightly closed by a cover 6 provided with a plurality of openings 8 which are uniformly distributed over the surface of the cover and which are connected to a pipe conduit 7, thus providing a passage from the pipe conduit into the container. Rapid connector means 10 are provided for connecting the pipe conduit 7 with a flexible hose 9 leading to a water supply source such as a pump or the like not shown. It will be noted that the coke 5 has a substantially uniform depth over the entire bottom surface 2 of the container 1, formed by the top of the box 3.

As soon as the water supply is switched on, vapor is generated in the upper layers of the hot coke material 5. This vapor must flow downwardly through the bulk material since it does not have any other escape route.

In this manner substantially an equilibrium is established between the vapor generated in the upper layer of the bulk material 5 and the water proportion carried along into the depth of the bulk material 5, said water proportion being present in the form of non-vaporized droplets. Thus, the zone of the water vaporization proper is distributed between the space under the cover 6 and the entire bulk material 5 as a function of the water quantity supplied per unit of time. The above mentioned so called Leidenfrost phenomenon is here also effective. As a result, water droplets could be carried along through the hot coke material 5 all the way into the vapor exit if the vapor speed were too high. Thus, it is preferred to properly control the water quantity supplied per unit of time. It has been found that there is a physical correlation among the water quantity supplied per unit of time, the vapor pressure, and the temperature of the vapor escaping at the perforated bottom 2. The vapor pressure increases and the starting vapor temperature decreases as a function of the increasing water quantity. This is apparently due to the fact that the entrained water droplets lower the center of the vapor formation space, whereby the super-heating distance through which the vapor must travel downwardly through the hot coke material 5 becomes shorter. In the experimental arrangement a pressure of about 320 to 1500 millimeter water column was established and could be read from a pressure measuring device 11 when the uniformly supplied water quantity was within the range of about 80 to 270 liters per minute.

A water reaction occurred during the performing of the test as it does in all direct coke quenching methods. The water proportion in the hot vapor having a temperature of about 600°C is initially, that is, during the first few fractions of a second after the beginning of the water supply, still high enough to ignite immediately upon its exit into the atmosphere. However, the flame extinguishes rapidly. Simultaneously, the vapor temperature drops within about 45 to 75 seconds to a temperature of about 250° to 400°C which is indicated by a thermo element 12 measuring substantially without delay.

The quenching process may be considered to be completed when the vapor temperature reaches 300°C. However, this does not appear to be critical, since coke batches for which the quenching process was interrupted at a vapor temperature somewhat above 400°C also showed a perfect quenching result.

The following Table 1 illustrates the characteristic results of several tests which were performed with different parameters. The non-linearities which may be noted from Table 1 are due to the statistical differences in the coke bulk material in the container 1 which is relatively small as compared to the grain size of the coke.

Table 1

| Test No. | Water Quantity (liters) | Quenching Time (Seconds) | Liter/ Minute | Initial Pressure mm Wat. Col. | Initial Temp. °C | End Temp. °C | Water Con. % |
|---|---|---|---|---|---|---|---|
| 1 | 200 | 46 | 262 | 1500 | 450 | 270 | 0.1 |
| 2 | 200 | 75 | 160 | 1000 | 470 | 300 | 0.7 |
| 3 | 180 | 72 | 150 | 1400 | 460 | 150 | 0.5 |
| 4 | 220 | 90 | 146 | 1200 | 400 | 100 | 2.14 |
| 5 | 150 | 65 | 140 | 700 | 550 | 420 | 0.15 |
| 6 | 150 | 113 | 79 | 320 | 500 | 270 | 1.1 |

The water content in the coke or rather in the final product depends on the quenching power and the temperature at the completion of the quenching.

Table 2 illustrates the water or moisture content in percent of the water quantity supplied and with reference to the various grain size ranges.

Table 2

| Grain Size | Water Content % | | | |
|---|---|---|---|---|
| 80mm | 0.03% | 0.1% | 0.3% | 1.3% |
| 80... 60mm | 0.06% | 0.2% | 0.3% | 2.5% |
| 60... 40mm | 0.4% | 0.3% | 0.7% | 3.9% |
| 40... 20mm | 1.1% | 0.4% | 1.0% | 5.9% |
| 20... 10mm | 0.9% | 0.2% | 6.4% | 5.0% |
| 10mm | 0.1% | 1.1% | 1.1% | 3.7% |
| | Average Water Content % | | | |
| | 0.1% | 0.15% | 0.5% | 2.14% |

In all tests the quenching container held a contents from about 470 to 490 kg of coke. Thus, the water consumption ranged from 320 to 460 liters per ton of coke. The quenching water was partially released to the atmophere in the form of super-heated vapor or steam and a proportion remained in the coke, said proportions corresponding to the percentage figures shown in Table 2. Significantly, quenching water backflow and water condensation did not occur.

An essential element for performing the present method is the quenching container, which may be constructed as a quenching car. This container should have, as mentioned, a bottom surface, which is as small as possible in order to achieve a plane surface of the coke material and thus a substantially uniform depth of the coke material in the container. Therefore, the container will preferably have a cubic shape also in order to accommodate the normally rather small available height between a service or charging platform located on the coke discharge side of a horizontal oven battery and the quenching rails. However, the invention is not limited to a cubical shape. The quenching container may also have a cylindrical form which may be rather advantageous with regard to the thermal durability of such container.

Figure 2:
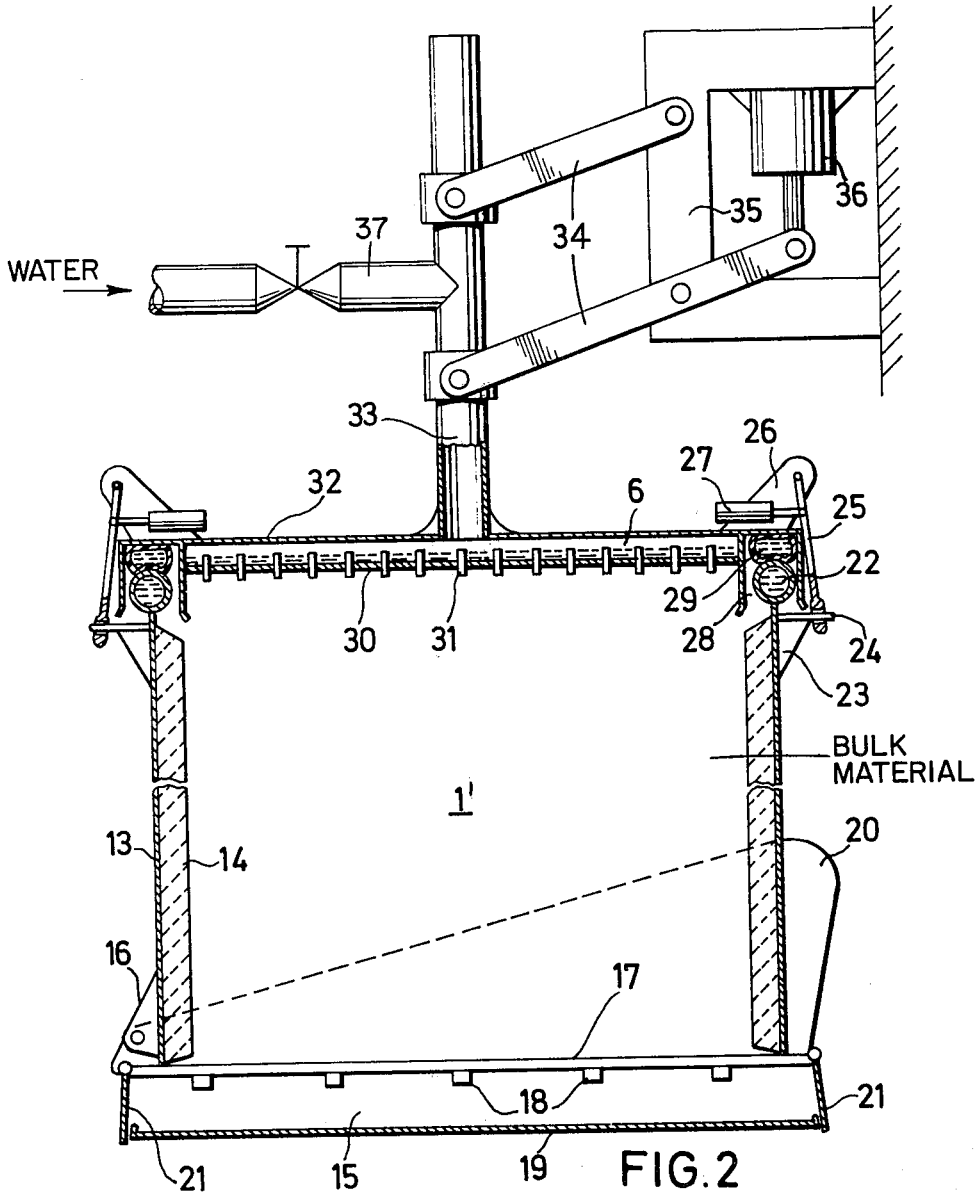
FIG. 2 illustrates a side view also partially in section through a practical embodiment for the volume quenching of bulk materials in accordance with the teachings of the present invention.

FIG. 2 illustrates a suitable embodiment of an apparatus for performing the present method on a practical scale. The vertical walls 13 of the quenching container 1' are provided with a refractory lining 14. The lower bottom of the container 1′ is formed by a movable bottom box 15 which is tiltable by means of journal joints 16. The top portion of this tiltable bottom box 15 is constructed in the form of a grid comprising grid rods 17 extending in parallel to the plane of the drawing. These grid rods 17 are supported by cross beams 18. The bottom 19 of the box 15 is closed and extends into upwardly reaching side walls 20 which are shaped in such a manner that the coke is prevented from laterally escaping out of the box 15 when the box 15 is tilted downwardly for the discharge of the coke from the container 1 through the box 15. Along the side where the journals 16 are located and along the opening side the box 15 is closed by hinged side walls 21, which are easily movable to permit the escape of the quenching steam. However, these hinging side walls 21 prevent the entrance of air during the filling of the quenching container. The bottom box 15 is moved, for example, by hydraulic means in order to discharge the contents from the container 1′.

According to the invention, the vertical walls 13 of the quenching container 1′ have upper edges formed by pipes 22 extending all along these walls. These pipes 22 are cooled by water flowing therethrough. Further, there are brackets 23 secured to the outside of the walls 13 which support the cover 6 prior to the beginning of the quenching process. The brackets 23 are each provided with a bolt 24 which fits into the opening of a locking anchor 25. The locking anchors 25 are pivotally secured to respective support members 26 carried by the cover 6. These locking anchors 25 are operable by hydraulic piston cylinder means 27 for moving the locking anchors 25 into and out of the locking position.

The cover 6 is provided with a protection and guide channel 28 extending as a collar all around the downwardly facing edge of the cover 6. A hose 29, for example, made of Teflon (Trademark) is held in the bottom of the channel 28. Water flows through this hose 29 for cooling purposes. The hose 29 rests on the pipe 22. After the locking anchors 25 have been moved into their locking position as shown in FIG. 2, the pressure in the hose 29 is increased, whereby a complete seal is accomplished between the cover 6 and the container 1′.

The cover 6 is also constructed as a box, the downwardly facing wall 30 of which is provided with apertures through which tubes 31 extend. The tubes 31 may, for example, be welded to the bottom 30 of the cover 6. It has been found that about twentyfive tubes 31 evenly distributed over the area of one square meter will assure an even distribution of the quenching liquid. The tubes 31 are so positioned that about 80% of their length reaches into the space between the bottom 30 and the top wall 32 of the cover 6. Thus, a quantity of water will be retained in the cover 6 for cooling purposes.

The space inside the cover 6 communicates with a connecting pipe 33 secured to the top surface 32 of the cover 6. The pipe 33 in turn communicates with a laterally extending pipe 37 connected to a water supply not shown. The pipe 33 is also connected to parallel guide members 34 which in turn are secured with their opposite ends to a supporting structure 35 forming part of a quenching tower. The supporting structure 35 carries an adjustment piston cylinder means 36 for raising or lowering of the cover 6 relative to the quenching container 1′.

The supporting and connecting pipe 33 has an open upper end whereby it operates as a safety valve. To this end the pipe has a length corresponding to about 1.5 times the height of the container 1′. This height of the pipe 33 is selected with due regard to the fact that the highest vapor or steam pressure which may occur during the quenching has been found to be approximately 1500 mm water column per meter of coke depth in the container. A quantity and time controlled water supply means is connected to the pipe 37 as mentioned above. The circulation and the quantity as well as the pressure of the cooling water for the hose 29 and if desired, also for the pipe 22 is accomplished through a flexible connecting hose not shown. The control of the piston cylinder arrangement 27 is also accomplished over hydraulic flexible connecting lines not shown.

Figure 3:
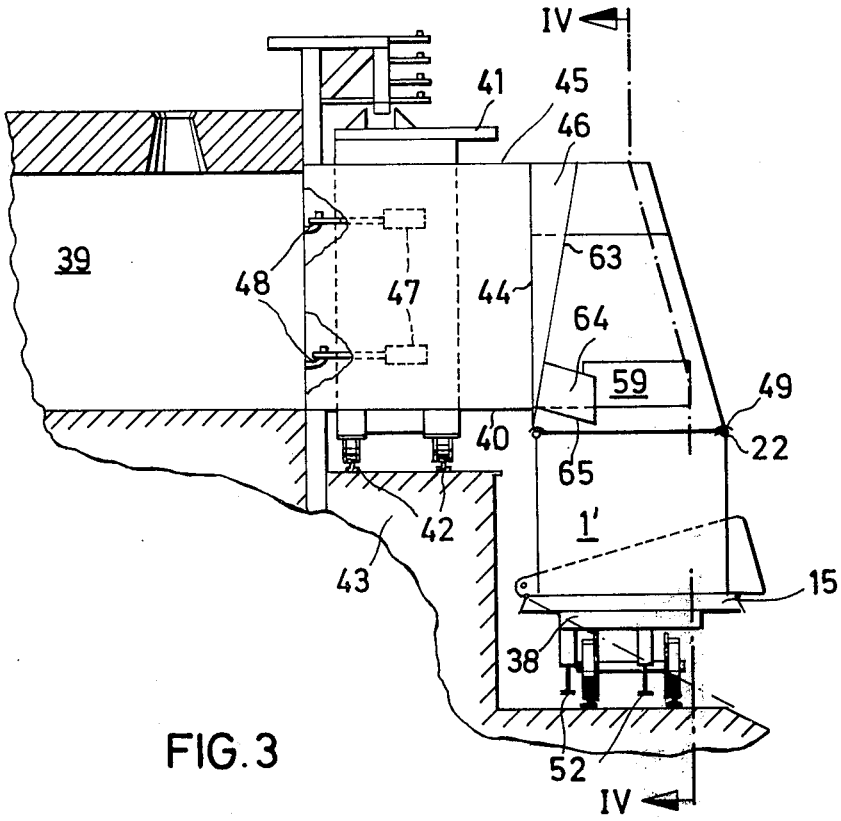
FIG. 3 illustrates schematically the position of a quenching car in front of a horizontal chamber oven, partially in section along the section line III—III in FIG. 4.
Figure 4:
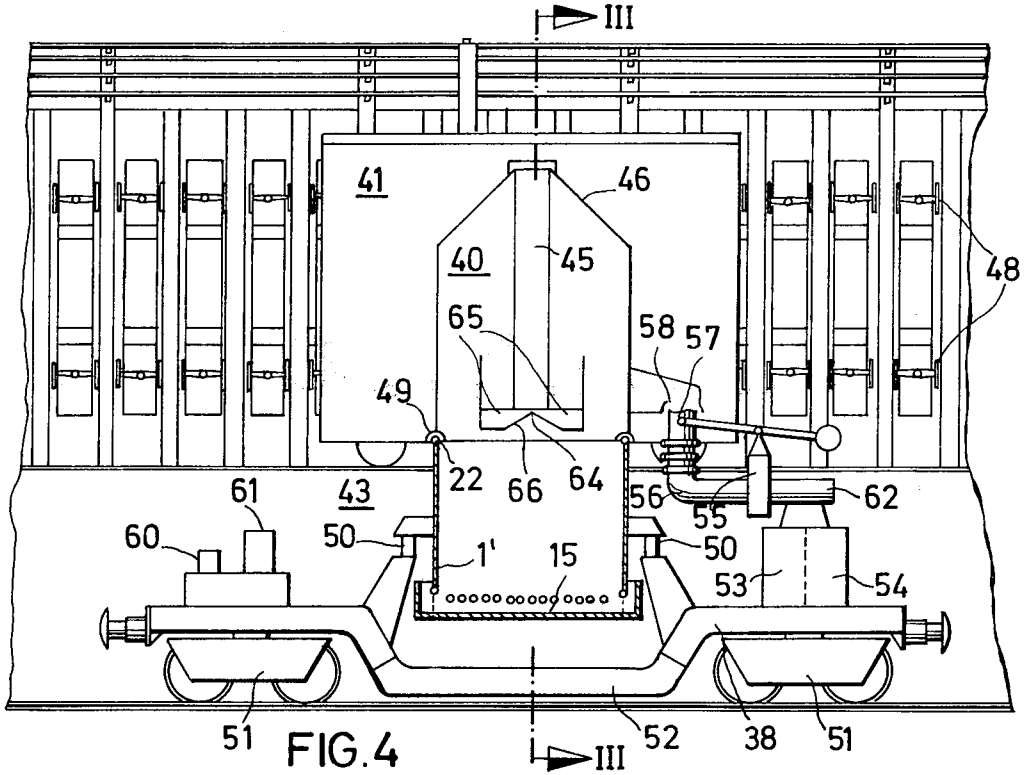
FIG. 4 is a sectional view along the IV—IV in FIG. 3.

Referring to FIGS. 3 and 4, the present method may best be performed by mounting the container 1′ on a low bed loader 38 and by securing the cover structure 6 to a quenching tower. The container 1′ is shown in position in front of a horizontal chamber oven 39 ready for discharge by horizontally effective pusher means not shown. A coking mass guide means or chute 40 is supported in a coking mass guide carriage 41 running on rails 42 of a service platform 43. The coking mass chute 40 is constructed substantially as a container open at two sides or ends. The container forming the coking mass chute 40 comprises a slender member 45, the dimensions of which are adapted to the dimensions of the horizontal chamber oven 39, and a larger member 46 merge into each other along the line or edge 44. The dimensions of the larger member 46 are adapted to the dimensions of the quenching container 1′. The end of the member 45 of the coking mass chute 40 adjacent to the open coking oven 39 fits with the sealing surface of the removed door and the chute 40 is tightly connected to the oven opening by means of a hydraulically operated tightening mechanism 47 including hooks 48 cooperating with the door locking mechanism.

The larger portion 46 of the chute 40 has a downwardly facing open side provided with semi-circular sealing surfaces 49 which according to the invention are dimensioned so that the water cooled pipe 22 surrounding the upper edge of the quenching container 1′ fits into said semicircular sealing surfaces 49. Prior to moving the low bed loader 38 with the quenching container 1′ thereon into the space below the larger member 46 of the chute 40 the container 1′ is lowered for about 100 mm by means of a hydraulic piston cylinder arrangement 50. As soon as the container 1′ is in the proper position for alignment with its pipe 22 with the surfaces 49, the container is raised again in order to provide the sealing engagement with the chute 40. The low bed loader 38 rests on two bogies 51. The bogies 51 are interconnected by carrier beams 52 forming the low bed loader 38. These beams 52 are bent downwardly in order to provide sufficient clearance for the bottom box 15 when the quenching container 1 is to be emptied.

The right-hand bogie 51 shown in FIG. 4 has mounted thereto containers 53 and 54 for fresh water and mud water of a rotary washer 55. The washer 55 is connected to the chute 40 by means of a suction pipe 56 which in turn is connected through a corrugated elastically flexible pipe and a coupling member 57 to a connector 58 of the exhaust outlet 59 of the larger member 46 of the chute 40. Simultaneously with the aligning of the quenching container 1′ with the sealing surface 49 of the chute 40 there is also established a connection between the coupling member 57 and the connector 58 by hydraulic means. The left-hand bogie 51 carries pump means 60 for the hydraulic operating devices of the four piston cylinder arrangements 50 which raise and lower the quenching container 1' and which operate the bottom box 15 as well as the suction pipe 56. A control apparatus 61 coordinates the movement sequences and prevents the movement of the low bed loader 38 of the guide carriage 41 and of the coking mass guide or chute 40 when the latter and the quenching container 1' are interconnected. Simultaneously, the control apparatus assures that the pump for the circulating cooling medium in the sealing pipe 22 and a drive motor 62 for the rotary washer 55 are switched on.

The slender member 45 of the chute 40 reaches into the larger member 46 of the chute 40 along an edge 63 extending beyond the edge 44 in such a manner that a breakdown of the coking mass from the bottom upwardly is assured. As the coking mass is extruded from the oven 39, the lower surface of the coking mass moves onto a saddle 64 comprising surfaces 65 which slant forwardly and downwardly. These surfaces 65 cooperate with flanks 66 of the saddle 64 in order to separate the coking mass along the so called tar seam and in order to impell the downwardly falling coke pieces in the direction toward the opposite corners of the quenching container 1'.

During the extrusion of the coking mass from the coke oven chamber 39 and during the filling of the quenching container 1' the air in the chute 40 and in the quenching container 1' is enriched with dust and heated as well as displaced as a result of the extrusion. Assuming that the coke volume is 25 cubic meters, and that the air is heated to a temperature of 500°C during an extrusion time of 45 seconds, then it is necessary to design the rotary washer 55 for a suction and washing power or performance of 8,000 cubic meters per hour, taking into account 50% of entrained air through the gaps of the apparatus.

The above suction and wash power of about 8,000 cubic meters per hour is small compared to other devices employed for the reduction of dust emission in connection with the extrusion of the coking mass from the coking oven. This reduced suction and washing power constitutes a further improvement in the environmental effects of a coking oven operation. This reduction, however is possible only because according to the invention, the transfer of the coke into the quenching car is accomplished in a closed space.

From experience it can be said that the dust emission effects cease when the coke comes to rest in the quenching car after its extrusion from the coke oven chamber. Therefore, it is possible to move the quenching container 1' to a quenching tower without any cover member after the container 1' has been lowered out of the sealing contact with the coking mass guide or chute 40. As soon as the quenching container 1' has reached the proper position underneath the cover 6 as illustrated in FIG. 2, the cover 6 is lowered and the locking mechanism is closed. Thereafter, the pressure in the sealing hose 29 is increased in order to seal the cover to the container by increasing the pressure of the cooling water. Thereafter the quenching water supply is switched on.

In order to produce a coke having a final water content of about 0.2% it is necessary to press five cubic meters of water within 50 seconds into the quenching container 1' if the latter is filled with 12.2 tons of coke to be quenched. The pressure in the quenching container 1' will rise for a few seconds to 4,500 mm water column. As a result, the vapor or steam escaping through the flapping side walls 21 of the container 1' will have a temperature which drops exponentially from 400°C to 260°C.

The cooling water circulation is switched off as soon as the quenching process is completed, whereby the sealing between the cover 6 and the container 1' is removed. Thereafter the locking mechanism is opened and the cover 6 is lifted, whereupon the low bed loader 38 is moved to a ramp for discharging the contents of the quenching container 1'.

Although the invention has been described with reference to specific example embodiments, it will be appreciated, that it is intended to cover all modifications and equivalents within the scope of the appended claims.

What is claimed is:

1. A method for quenching heated bulk material coke, comprising filling the bulk material into a container so that the depth of the bulk material is uniform throughout the body of the bulk material on a substantially horizontal, perforated support, closing off the sides and top of the container in a pressure tight manner to seal the bulk material against the atmosphere, supplying the quenching liquid at room temperature uniformly only over the top surface of the bulk material in a multitude of substantially downwardly directed parallel pressurized sprays, whereby the liquid and the vapor developed by the quenching, flow in parallel current fashion downwardly throughout the body of the bulk material, maintaining the quenching liquid supply for about 45 to 90 seconds until the vapor temperature has been cooled down to 400°C at most, or a temperature lower than 400°C and limiting the quenching liquid quantity as a function of the bulk material so that the range of liquid consumption is about 320 to 460 liters per ton of coke so that it evaporates substantially completely except for a small remainder retained as its moisture content by the bulk material, and keeping said remainder moisture content below 2% of the quantity of quenching liquid supplied to the top of said bulk material.

2. An apparatus for the quenching of bulk material, especially coke, comprising a fireproof container for the bulk material, said container having unperforated substantially straight, vertical side walls, whereby bulk material may be piled therein with substantially uniform depth, cover means for closing said container in a pressure tight manner at the top of the container, said cover means including quenching liquid supply means and a plurality of liquid supply openings facing downwardly into the container, said apparatus further comprising box means forming a movable dump bottom for said container for emptying the quenched material from the container, said movable dump bottom forming box means comprising at least one hinged side wall which flaps open outwardly, and a perforated member at the bottom of the container between the container and the box for holding bulk material in said container above said box means.

3. The apparatus according to claim 2, wherein said perforated bottom extends substantially horizontally and at right angles relative to the container.

4. The apparatus according to claim 2, wherein said box means has a grid at the top thereof, said grid forming said perforated member for the container.

5. The apparatus according to claim 2, wherein said hinged side wall is pivoted with its upper edge to an upper edge of the box means.

6. The apparatus according to claim 2, wherein said container comprises cooling pipe means forming the upper edge of the container, said cover means comprising cooling hose means extending along an outer edge of the cover means and contacting said cooling pipe means to seal the container.

7. The apparatus according to claim 2, further comprising connecting chute means for linking said container to a bulk material supply, said connecting chute means comprising sealing edge defining means, said container having upper edge means adapted for cooperation with the sealing edge means of said chute means.

8. The apparatus according to claim 2, wherein said box means are journaled to said container along one edge thereof, said box means having raised side walls for preventing the lateral escape of bulk material when the box means is tilted downwardly.

9. The apparatus according to claim 2, wherein said quenching liquid supply means comprise a vertical connecting and support pipe secured substantially centrally to the cover means proper to communicate with the inside of said container, said quenching liquid supply means further comprising connecting means communicating with said pipe and extending substantially horizontally away from the pipe.

10. The apparatus according to claim 9, wherein said vertical connecting and support pipe has an open upper end and a length corresponding substantially to 1.5 times the height of the container.

11. The apparatus according to claim 9, further comprising guide lever means secured to said vertical pipe, and power means connected to said lever means for manipulating the cover means.

* * * * *